US005178530A

United States Patent [19]

Roldan et al.

[11] Patent Number: 5,178,530

[45] Date of Patent: Jan. 12, 1993

[54] GAS HEATING DEVICE, WITH A CATALYTIC BURNER AND REGULATING MEMBER

[75] Inventors: Antoine Roldan, Mions; Nino Urbano, Oullins; Philippe Bottazzi, Rillieux-la-Pape, all of France

[73] Assignee: Application Des Gaz, Paris, France

[21] Appl. No.: 854,002

[22] Filed: Mar. 19, 1992

[30] Foreign Application Priority Data

Nov. 3, 1989 [FR] France ..... 89 15056

[51] Int. Cl.[5] ..... F23N 5/00

[52] U.S. Cl. ..... 431/75; 126/406; 126/409; 126/233

[58] Field of Search ..... 126/403, 406, 408, 409, 126/413, 414, 229, 223; 431/75

[56] References Cited

U.S. PATENT DOCUMENTS

| | | |
|---|---|---|
| 2,119,694 | 6/1938 | Wilhelm . |
| 4,243,017 | 1/1981 | Diederich . |
| 4,248,208 | 2/1981 | Diederich . |
| 4,327,752 | 5/1982 | Hickel . |
| 4,354,482 | 10/1982 | Beisecker . |
| 4,361,133 | 11/1982 | Bonnema . |
| 4,539,974 | 9/1985 | Tittert . |
| 4,631,024 | 12/1986 | Shibata et al. . |
| 4,688,551 | 8/1987 | Nakajima . |

FOREIGN PATENT DOCUMENTS

| | | |
|---|---|---|
| 0021224A1 | 1/1981 | European Pat. Off. . |
| 0030257A1 | 6/1981 | European Pat. Off. . |
| 2621981 | 4/1989 | France . |
| 60-117013 | 1/1985 | Japan . |
| 1216485 | 12/1970 | United Kingdom . |
| 2208540A | 4/1989 | United Kingdom . |

*Primary Examiner*—Carroll B. Dority
*Attorney, Agent, or Firm*—Oliff & Berridge

[57] ABSTRACT

A heating device with a catalytic burner for a fuel gas is equipped with a member for regulating the thermal power. The regulating member includes a metal flap for regulating the flow of the mixture to be burned in the catalytic burner. This flap, for example a heat-sensitive bimetallic strip, can move between two positions, namely a first position in which the mixture to be burned is stored in the device or discharged in the manner of a leakage through an orifice in a wall of the heating device, and a second position which allows a maximum flow rate of the mixture to pass through the catalytic burner. The invention applies to all types of heating devices with a catalytic burner.

17 Claims, 2 Drawing Sheets

GAS HEATING DEVICE, WITH A CATALYTIC BURNER AND REGULATING MEMBER

BACKGROUND OF THE INVENTION

The present invention relates, in a general manner, to gas heating devices, and more particularly to those of the portable type, of a relatively low caloric power and hence of a relatively limited consumption of fuel gas, for example at most equal to 5 g/hour.

DESCRIPTION OF THE PRIOR ART

In the document FR-A-2,621,981, a heating device is described of the above-defined type, and more precisely a portable soldering iron incorporating a reserve of fuel gas, for example butane, in the form of an interchangeable cartridge. Such a device comprises, in the direction of the circulation of the fuel gas:

a member for controlling the gas current of the pressurized fuel gas, consisting of a means for leak-tight and reversible coupling to a cartridge of pressurized fuel gas an injector ejecting a gas jet from the gas current a means for the entrainment of primary air by the gas jet in order to form the mixture to be burned, which can consist of a converging/diverging element of the venturi type, or of a simple tube whose upstream end is situated at a distance from the injector, these various means communicating in an appropriate manner with the outer atmosphere, in order to draw in primary air under the effect of the entrainment by the jet of the fuel gas a duct for transporting the mixture to be burned, communicating with, or related to, at its upstream end, the means for the entrainment of primary air an induced-air catalytic burner having a catalytic combustion structure, namely a refractory ceramic core termed a "honeycomb", having a plurality of channels elongated in the direction of the passage of the gases and whose inner face is coated with a catalyst; this structure is traversed by the mixture to be burned, from its inlet face related to the downstream end of the transport duct, to its outlet face giving out the combustion vapors a metallic active, or working, part, comprising a soldering bit, in a heat-exchange relation with the burner, and consuming some, if not all, of the caloric power produced by the catalytic combustion of the fuel gas.

As for any heating device, when functioning, it appears necessary to modulate the caloric power produced by the abovementioned device, in particular as a function of the thermal power actually dissipated, for example depending on whether the soldering iron is waiting to be used for a soldering operation or is actually being employed for such an operation.

To this end, various regulation or control solutions can be envisaged. The most simple make use of the detection of the temperature in a zone of the device in a heat-exchange relation both with the burner and with the active part, representing the dissipated thermal power, and of the command of a control parameter of this power, by means of the temperature thus detected.

According to the document U.S. Pat. No. 2,119,694, and for a portable heating device with a naked-flame burner, to the smoothing iron type, the control parameter selected is the flow rate of the supply fuel gas. In practice, and subsequently, other portable heating devices with a catalytic burner have retained the same regulation solution, providing, on the one hand, a metallic temperature-detection element which can modify its position or shape according to the temperature detected and, on the other hand, a valve for controlling the flow rate of the fuel gas, for example with a shutter whose opening is controlled mechanically by the modification in position or shape of the detection element.

Such solutions are also those which are immediately accessible to the person skilled in the art, or the specialist in question, to the extent that, by analogy with portable electric devices having a thermostat, it is normal to control the delivered power by acting directly on the supply energy, in this case the fuel gas.

This being the case, for a gas-operated device which is portable and thus of a limited size or volume, these control solutions have significant disadvantages.

Firstly, they require the use of a valve, in other words a member with a movable shutter provided and constructed for the passage of relatively low flow rates, for example of the order of a few grams per hour. Relatively expensive precision-made parts are therefore needed if a high degree of reliability or safety is desired.

Secondly, they require an appropriate mechanical link, for example with a lever or angle transmission between the detector element and the valve, and more precisely its shutter. This link is generally obtained by the combination of various micromechanical parts whose assembly also requires a high degree of precision, and a high degree of cleanness.

In sum and in practice, these regulating members prove to be highly complex, difficult to manufacture and to assemble in large quantities, and of limited reliability.

SUMMARY OF THE INVENTION

The subject of the present invention is a novel regulation concept which can be applied and is specific to a portable heating device with an induced-air catalytic burner, which is particularly simple to implement, and consequently overcomes the above disadvantages.

This novel concept results from the two following observations and their combination, for a device of the abovementioned type and thus of a limited or relatively small thermal power:

on the one hand, the catalytic structure generally has a relatively considerable temperature lag, which enables it to remain in the zone of the temperatures of the catalytic functioning, after its supply has been interrupted, for a certain period of time; any new supplying of the burner, within a relatively brief period after its interruption, is capable of restarting the catalytic combustion process and, on the other hand, since the flow rates of fuel gas passing inside the device remain relatively low, it may be envisaged without any great disadvantage, either to divert some of the supply flow to the outside of the device, or to store temporarily some of the supply flow in the device and within it. With respect to the diversion of the fuel gas or of the mixture to be burned to the outside of the device, this has no disadvantage for use outdoors; however, this is also permissible for use in domestic premises, the supply flows employed generally not being able to reach the known zones of inflammability of an air/butane mixture for example.

Under these conditions, the present invention aims to control the thermal power of a heating device with an induced-air catalytic burner, not by modifying the flow rate of the fuel gas ejected by the injector, but by controlling the flow rate of the mixture to be burned supplying the catalytic structure, this control being obtained from the flow rate of the fuel gas, remaining relatively constant, all other things being equal. According to this method of regulation, the flow rate of the mixture to be burned or of the fuel gas, which is excess or supplementary relative to the controlled flow rate of the mixture to be burned, is either given out towards the outside of the device, directly into the surrounding atmosphere, or stored temporarily within the device.

More precisely, according to the present invention, a member is provided for regulating the flow rate of the mixture to be burned circulating in the transport duct, arranged downstream of the means for the entrainment of primary air and upstream of the catalytic combustion structure. This member comprises, in addition to the element sensitive to the temperature generated by the burner, a sealing flap which can move between two positions under the influence of the temperature detected by the sensitive element, namely:

a first position, termed the blocking position, for a relatively high value of the temperature detected and a second position, termed the open position, ensuring the passage of a maximum flow rate of the mixture to be burned to the catalytic structure, for a relatively low value of the temperature detected.

As with all regulation, the control method according to the invention can be "all or nothing", or "all or a little"; or proportional.

The temperature-sensitive element and the sealing flap are preferably, and in a particularly simple manner, one and the same metal flap in a heat-exchange relation with the burner and capable of assuming two positions or shapes according to its equilibrium temperature, one blocking with respect to the catalytic structure and the other open with respect to the catalytic structure.

Two main embodiments characterize the invention.

According to the first, the sealing flap is related to an upstream orifice for discharging the mixture to be burned to the outside, and in the first blocking position of the flap, a leakage current of the mixture to be burned or of the fuel gas is given out through the discharge orifice. It is this first embodiment which will be described more particularly hereinbelow.

According to a second embodiment, the sealing flap is related to a non-return member for the mixture to be burned or for the fuel gas, by way of a non-return shutter sealing a leakage orifice provided in the duct for transporting the mixture to be burned, and thus upstream of the sealing flap. In the first sealing position of the flap, a temporary volume of the mixture to be burned or of the fuel gas is stored in the device, in the manner of a capacity, between the sealing flap and the non-return member.

BRIEF DESCRIPTION OF THE DRAWINGS

The present invention is now described with reference to the attached drawings, in which.

DESCRIPTION OF THE PREFERRED EMBODIMENTS

Figure 1:
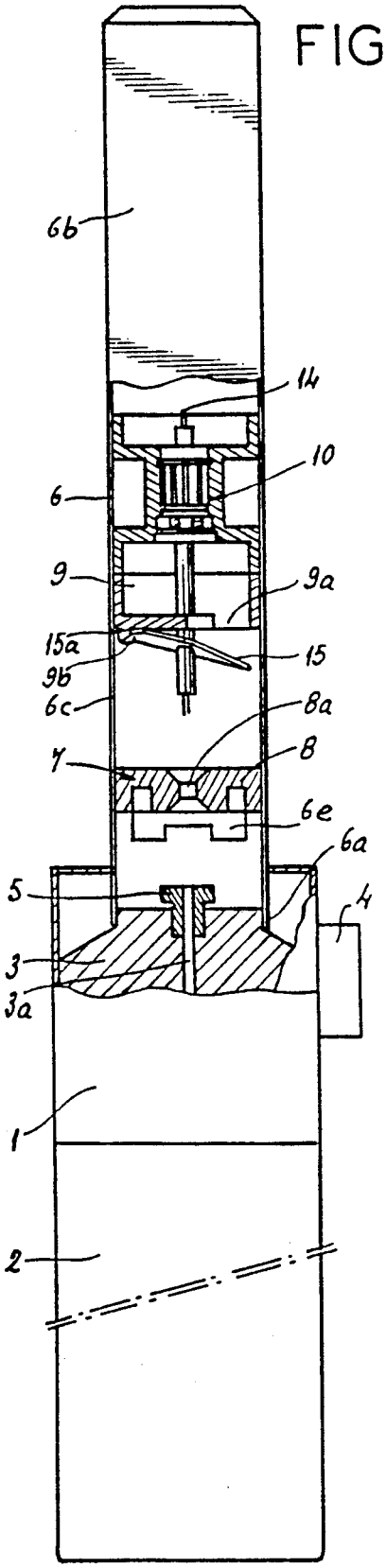
FIG. 1 shows a view with partial cutaway of a heating device according to the present invention consisting of curling tongs
Figure 2:
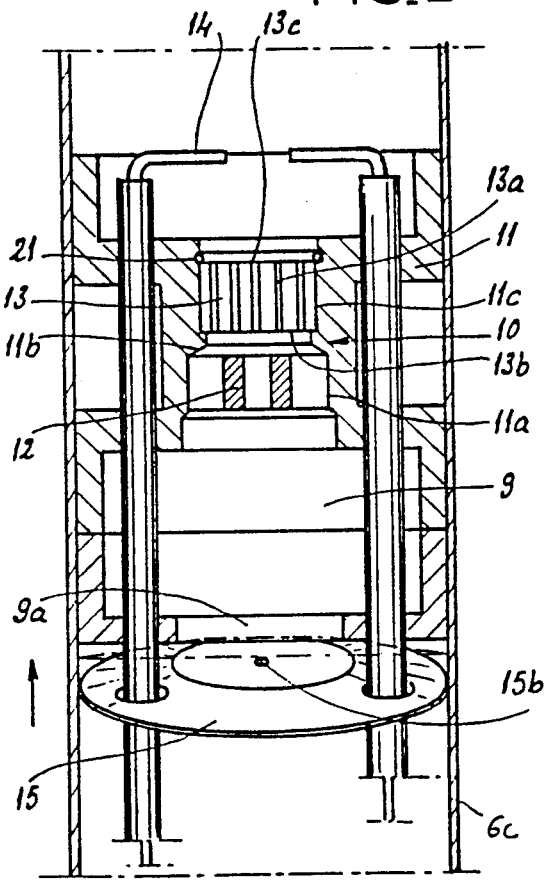
FIG. 2 shows a view on a larger scale, in axial section, of the catalytic burner and of the regulating member belonging to the device shown in FIG. 1

Referring to FIGS. 1 and 2, a heating device according to the invention, namely curling tongs, comprises in succession, in the direction of the circulation of the fuel gas:

an outer streamlined body (1), of cylindrical shape and made from plastic, onto which is screwed in a removable manner a cylinder (2) intended to receive and mount an interchangeable cartridge of fuel gas (not shown)

a metal body (3) comprising an inner channel (3*a*) for the circulation of the pressurized fuel gas, with which there are combined, optionally, a pressure-reducing valve (not shown) enabling the pressure of the fuel gas to be controlled irrespective of the ambient temperature in particular, and a member for controlling the current of pressurized fuel gas, likewise not shown, enabling in a general manner, the inlet of the fuel gas to be opened or closed; moreover, this control member and the pressure-reducing valve can be one and the same thing, the pressure-reducing valve having, to this end, a manual-control member such as the button (4) shown in FIG. 1 an injector (5), at the opening of the channel (3*a*), ejecting a gas jet from the current of pressurized fuel gas a metal tube (6) fastened at one end (6*a*) to the metal body (3) and forming, at its end part (6*b*), the active or working zone of the device, and more precisely a smooth zone for curling and heating locks of hair; as described below, this tube (6) also serves as a duct for circulating the gases in the device, in particular the mixture to be burned a means (7) for the entrainment of primary air by the gas jet emitted from the injector (5), in order to form the mixture to be burned; to this end, the means (7) comprises a ring (8) and holes (6*e*) for the introduction of primary air; the ring (8) is fitted inside the tube (6), on the side of its end (6*a*), opposite the injector (5), and it comprises an axial pierced hole (8*a*) aligned with the axis of ejection of the injector (5) and having the form of a venturi, in other words comprising, in succession, in the direction of circulation of the gas, a converging part, a straight part, and a diverging part; the holes (6*e*) are formed in the wall of the tube (6) between the ring (8) and the injector (5)

a chamber (9) for distributing the mixture to be burned having the form of a tubular capacity mounted inside the tube (6), arranged upstream of the catalytic burner which will be dealt with later and communicating by way of a passage (9*a*) with the part (6*c*) of the tube (6) forming a duct for transporting the mixture to be burned between the outlet of the means (7) for the entrainment of primary air and the inlet of the catalytic burner below a catalytic burner (10) comprising a metal core (11), forming from the inlet to the outlet of the burner, a bore (11*a*) with shoulder (11*b*) for the introduction and maintenance of a coil (12) or another element for distributing the mixture to be burned, a recess (11*c*) of a smaller diameter for maintaining, with a ring (21), a refractory ceramic core (13) traversed, from its inlet face to its outlet face, by a plurality of channels (13*a*) whose inside is coated with a combustion catalyst; the catalytic structure (13) is thus traversed by the mixture to be burned, from its inlet face (13*b*) related to the downstream end of the transport duct (6*c*) to its outlet face (13*c*) for giving out the combustion vapors; igniting electrodes (14), enabling an electric spark to be generated, are associated with the burner (10) on the side of its outlet face (13*c*).

According to the present invention, the device shown in FIGS. 1 and 2 comprises a member for regulating the flow rate of the mixture to be burned circulating in the transport duct (6*c*) arranged in a general manner downstream of the means (7) for the entrainment of primary air and upstream of the catalytic combustion structure (13). This member comprises a metal flap (15) forming both an element sensitive to the temperature generated by the burner (10) and a sealing flap related to the holes (6*e*), which also have the function of upstream orifices for discharging the mixture to be burned, or excess fuel gas, to the outside.

In accordance with the first embodiment of the invention according to FIGS. 1 and 2, the shutter (15) consists of a metal disk having a certain intrinsic stiffness and capable of returning suddenly, at a relatively high temperature, from a spaced-apart position shown in FIG. 2 to a position applied against the distribution chamber (9), which position is shown in dot-dash lines in FIG. 2, and this takes place in the direction of the arrow in this same FIG. 2. This metal flap is fixed at one end (15*a*) onto a fastening stud (9*b*) of the distribution chamber (9).

Consequently, according to FIGS. 1 and 2, the metal flap (15) is associated and interacts, when open or closed, with the intermediate passage (9*a*) to the distribution chamber (9).

More precisely, the flap (15) can move under the influence of the detected temperature, between two positions, namely:

a first blocking position, shown in FIG. 2 in dot-dash lines, sealing the intermediate passage (9*a*) and causing a leakage current of the mixture to be burned or of the fuel gas to be given out through the holes (6*e*), also forming discharge orifices, and this occurs for a relatively high value of the temperature detected and a second open position, shown in solid lines in FIG. 2, freeing the intermediate passage (9*a*) and ensuring the passage of a maximum flow rate of the mixture to be burned towards the catalytic structure (13), and this occurs for a relatively low value of the temperature detected.

According to FIG. 2, the metal flap (15) itself has a perforation (15*b*) of minimum cross-section, related to the intermediate passage (9*a*) and ensuring the passage of a minimum flow rate of the mixture to be burned, in the deflecting position of the sealing flap shown in dot-dash lines in FIG. 2.

In accordance with the embodiment according to FIGS. 1 and 2, it is possible to obtain a regulation of the temperature to within 10° C.

The embodiment according to FIG. 3 differs from that shown in FIGS. 1 and 2 in the following technical features:

in a general manner, the heat-sensitive metal flap (16) consists of a straight bimetallic strip fixed at one end (16*a*) on a protuberance (9*c*) of the receiving chamber (9), parallel to the wall of the tube (6); this bimetallic strip (16) carries a sealing boss (16*b*) at its end opposite its fixed end (16*a*)

the upstream orifice for discharging the mixture to be burned or the fuel gas consists of a leakage opening (6*g*) formed in the wall of the transport duct (6), between the receiving chamber (9) and the means (7) for the entrainment of primary air under these conditions, the sealing shutter (16*a*) can move between two positions, namely a first blocking position, spaced apart from the wall of the tube (6) and opening the leakage opening (6*g*), for a relatively high detected temperature, and a second position open to the burner (10), applied along the wall of the tube (6), in which the boss (16*b*) seals the leakage opening (6*g*), for a relatively low detected temperature.

Figure 3:
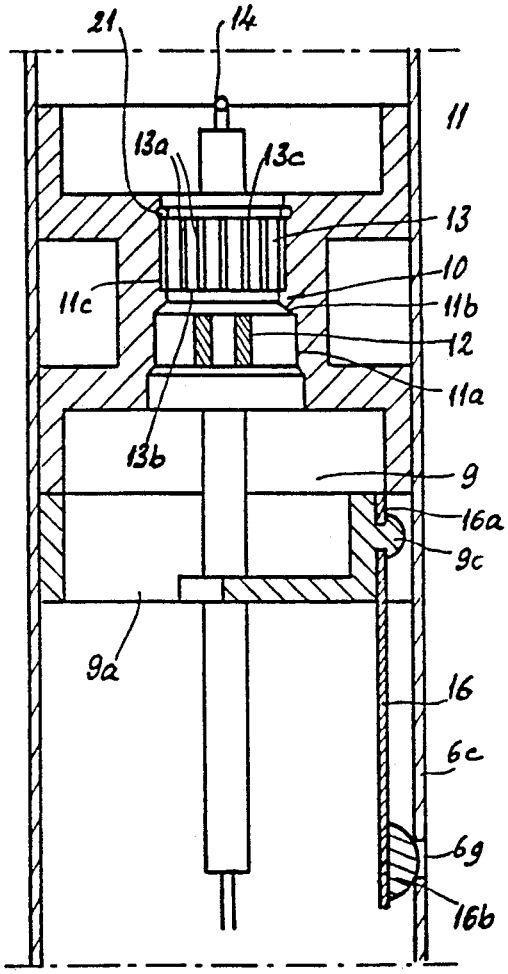
FIG. 3 shows a view, on the same scale as that in FIG. 2, of the catalytic burner and of its regulating member in a second embodiment of a heating device according to the present invention.
Figure 4:
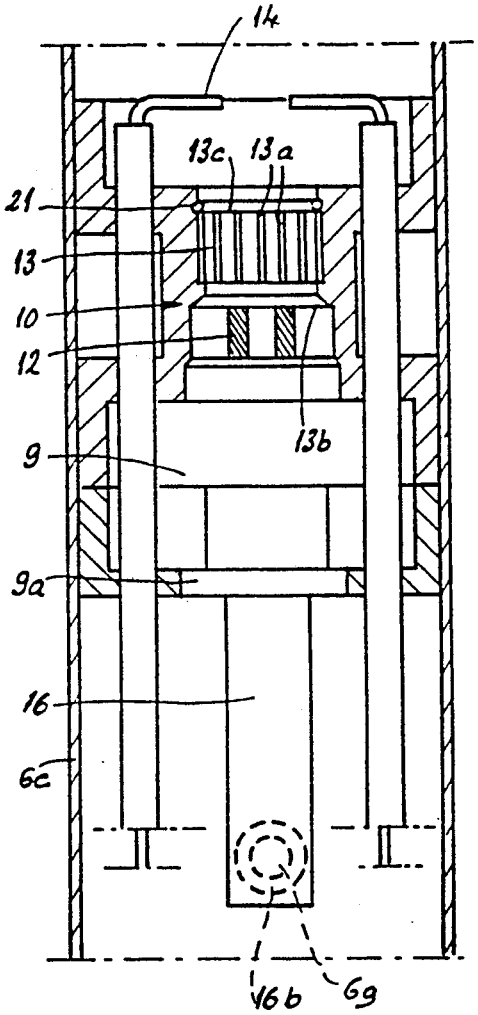
FIG. 4 shows a view of the second embodiment along a plane of section perpendicular to that in FIG. 2.

In accordance with the embodiment according to FIGS. 3 and 4, it is possible to obtain a fine regulation of the temperature, of the proportional type.

By virtue of the invention, for a catalytic burner having a heat load of the order of 100 watts per $cm^2$, it is possible to regulate the temperature at a mean value of 140° C. for example, with a start-up from ambient temperature lasting for of the order of 15 seconds.

The present invention can be applied to all types of portable heating devices, among which there may be mentioned:

certain household devices such as a mini-heater devices intended for the bathroom such as curling tongs and various do-it-yourself devices such as a soldering iron.

We claim:

1. A heating device for burning a pressurized fuel gas comprising:

means for controlling a current of the pressurized fuel gas;

an injector for ejecting a gas jet from the gas current flowing from said means for controlling;

means for entrainment of primary air by the gas jet, in order to form a mixture of gas and air to be burned;

a transport duct for transporting the mixture to be burned from the means for entrainment;

a catalytic burner comprising a catalytic combustion structure which is traversed by the mixture flow an inlet face of the catalytic combustion structure in fluid communication with a downstream end of the transport duct, to an outlet face of the catalytic combustion structure which emits combustion vapors of the burned mixture; and means for regulating the flow rate of the mixture to the catalytic burner comprising an element sensitive to the temperature generated by the combustion in said burner;

wherein said means for regulating the flow rate of the mixture is arranged downstream of the means for the entrainment of primary air and upstream of the catalytic combustion structure, said regulating means further comprising a sealing flap which can move between two positions in response to the temperature detected by the temperature sensitive element, said two positions being a first position when a relatively high value of the temperature is detected, and a second position which ensures the passage of a maximum flow rate of the mixture to be burned to the catalytic structure when a relatively low value of the temperature is detected.

2. A device as claimed in claim 1, further comprising at least one upstream flow orifice positioned in a wall of said transport duct upstream from the sealing flap for discharging the mixture to be burned, or the flue gas, to the outside, wherein in the first position of the flap, a leakage current of the mixture to be burned or of the fuel gas is discharged through the at least one upstream flow orifice.

3. A device as claimed in claim 1, wherein in the first position of the flap a temporary volume of the mixture to be burned or of the fuel gas is stored in the device.

4. A device as claimed in claim 1, wherein the sealing flap comprises the temperature-sensitive element which is in heat-exchange relation with the catalytic burner and capable of assuming two positions according to its temperature, corresponding to the first and second positions, respectively.

5. A device as claimed in claim 1, wherein the means for the entrainment of primary air comprises at least one hole in a wall of said transport duct and an element forming a venturi arranged coaxially with the axis of ejection of the injector, said at least one hole being positioned between the injector and the element forming a venturi for discharging the mixture to be burned, or the flue gas, tot he outside in the first blocking position of the flap, and for introducing primary air into the device when the flap is in the second position.

6. A device as claimed in claim 2, wherein the flap opens the upstream flow orifice in the first position, and the flap closes the upstream flow orifice in the second position.

7. A device as claimed in claim 1, further comprising a chamber for the distribution of the mixture to be burned arranged within said transport duct upstream of the catalytic structure, said chamber including a passage which is blocked by said means for regulating in said first position.

8. A device as claimed in claim 4, including wall means in said transport duct forming a passage wherein the flap closes said passage in the first position, and at least partially opens said passage in the second position.

9. A device as claimed in claim 1, wherein the means for regulating comprises means for ensuring the passage of minimum flow rate of the mixture to be burned to the catalytic burner when said flap is in the first position.

10. A device as claimed in claim 9, wherein the means for ensuring comprises a perforation in the flap of minimum cross-section.

11. A device as claimed in claim 2, wherein the temperature-sensitive element and the sealing flap are the same metal flap in heat-exchange relation with the catalytic burner.

12. A device as claimed in claim 11, wherein the upstream discharge orifice comprises a leakage opening formed in the wall of the transport duct.

13. A device as claimed in claim 12, wherein the flap opens the leakage opening in the first position, and the flap closes the leakage opening in the second position.

14. A device as claimed in claim 4, including means forming a chamber in said transport duct including wall means forming a passage upstream of the catalytic structure, said passage cooperating with said means for regulating.

15. A device as claimed in claim 14, wherein the flap is arranged opposite the passage and closes said passage in the first position, and at least partially opens said passage in the second position.

16. A device as claimed in claim 15, wherein the means for regulating comprises means for ensuring the passage of a minimum flow rate of the mixture to be burned to the catalytic burner when said flap is in the first position.

17. A device as claimed in claim 16, wherein the means for ensuring comprises a perforation in the flap of minimum cross section.

* * * * *